US007252092B2

(12) United States Patent
Kelsey

(10) Patent No.: US 7,252,092 B2
(45) **Date of Patent: *Aug. 7, 2007**

(54) METHOD AND DEVICE FOR USING STYLING TAPE FOR BODY AND HAIR ACCESSORIZING

(76) Inventor: Martha Kelsey, 2106 Silver Lakes Cir., P.O. Box 788, Fairfield, IA (US) 52556

( * ) Notice: Subject to any disclaimer, the term of this patent is extended or adjusted under 35 U.S.C. 154(b) by 269 days.

This patent is subject to a terminal disclaimer.

(21) Appl. No.: 10/655,930

(22) Filed: Sep. 5, 2003

(65) Prior Publication Data

US 2004/0055615 A1 Mar. 25, 2004

Related U.S. Application Data

(60) Provisional application No. 60/410,090, filed on Sep. 12, 2002.

(51) Int. Cl.
*A45D 24/00* (2006.01)

(52) U.S. Cl. ..... 132/200

(58) Field of Classification Search ..... 132/200, 132/273, 285, 212; 428/66.6, 131, 343, 43; D28/39; 602/58, 41, 42; 40/633; 2/271
See application file for complete search history.

(56) References Cited

U.S. PATENT DOCUMENTS 2,399,545 A * 4/1946 Davis ..... 604/389
2,819,180 A 1/1958 Koenig
4,522,870 A * 6/1985 Esmay ..... 442/67
4,862,436 A 8/1989 Harilela
5,258,214 A * 11/1993 Cooledge et al. ..... 428/43
D344,177 S * 2/1994 Mennie et al. ..... D2/610
5,338,290 A * 8/1994 Aboud ..... 602/75
5,397,298 A * 3/1995 Mazza et al. ..... 602/75
5,616,387 A * 4/1997 Augst et al. ..... 428/43
5,857,217 A * 1/1999 Hsueh ..... 2/170
6,004,643 A * 12/1999 Scheggetman ..... 428/42.2
6,116,251 A * 9/2000 Stachowski ..... 132/273
6,397,854 B1 6/2002 Bailey
6,455,752 B1 * 9/2002 Vesey ..... 602/41

(Continued)

FOREIGN PATENT DOCUMENTS

EP 0733492 A1 9/1996

(Continued)

OTHER PUBLICATIONS

International Preliminary Examination Report, for International Patent Application No. PCT/US03/27930, dated Jan. 3, 2005, 7 pages.

(Continued)

*Primary Examiner*—Robyn Doan
(74) *Attorney, Agent, or Firm*—McKee, Voorhees & Sease, P.L.C.

(57) ABSTRACT

A method of using styling tape for body part and hair accessorizing is disclosed. The method may include cutting a self-adhesive tape into a strip or other elongate shape and stretching it to obtain at least some tension. The user may wrap the self-adhesive strip around a bundle of hair or a body part, and may press the self-adhesive strip onto itself to secure the strip or other elongate shape.

9 Claims, 2 Drawing Sheets

U.S. PATENT DOCUMENTS

| | | | | |
|---|---|---|---|---|
| 6,545,193 | B1 * | 4/2003 | Morgenstern | 602/41 |
| 6,782,648 | B1 * | 8/2004 | Mosher, Jr. | 40/633 |
| 2003/0009921 | A1 * | 1/2003 | McAllister | 40/299.01 |

FOREIGN PATENT DOCUMENTS

| | | |
|---|---|---|
| GB | 1135042 | 11/1968 |
| WO | WO 01/14489 A1 | 3/2001 |

OTHER PUBLICATIONS

Written Opinion for International Patent Application No. PCT/US03/27930, dated Aug. 20, 2004, 5 pages.
International Search Report for International Application No. PCT/US03/27930, dated Jan. 16, 2004, 8 pages.

* cited by examiner

METHOD AND DEVICE FOR USING STYLING TAPE FOR BODY AND HAIR ACCESSORIZING

RELATED APPLICATION DATA

The present application is a non-provisional application based on, and claiming the priority benefit of, co-pending U.S. provisional application Ser. No. 60/410,090, which was filed on Sep. 12, 2002, and is expressly incorporated herein by reference.

FIELD OF THE DISCLOSURE

The present invention generally relates to a method of accessorizing body parts, hair, etc. and, more particularly, to a method of accessorizing body parts, hair, etc. with self-adhesive styling tape.

BACKGROUND OF THE DISCLOSURE

The idea of decorating portions of the body and hair is known in the prior art, and is especially popular with children for both dress-up and amusement purposes. For example, use of necklaces, earrings, bracelets, anklets, and chokers have long been used to decorate the body. Similarly, many devices are known in the prior art that enable one to style or manage hair that also include an aesthetic benefit to the user. For example, items such as pony tail holders, pins, bungees, scrunchies, rubber bands, and barrettes have all been used to hold, manage, or otherwise decorate the hair.

Each of the above mentioned items, whether used to decorate the body, or whether used to manage the hair have, however, one or more undesirable qualities. For example, none of the above mentioned items are easily adapted to be used as both decoration for the body and for management of the hair.

Similarly, items used for decorating the body, such as the necklaces, earrings, and bracelets, may have additional undesirable qualities such as cost and safety concern. The cost of jewelry, for example, whether real, fake, or costume, may be very expensive when purchased for a child to use or play with. The jewelry may also create a safety concern, especially when used by a young child. A child may, for example, swallow an earring and/or get choked by a necklace or the like. The jewelry may also be difficult for a child to use, considering the complexity and diminutive size of some of the clasps or locking mechanisms.

The devices used to manage hair may have additional undesirable qualities, such as being uncomfortable and/or difficult to use. A device, such as a pony tail holder and a barrette may be hard and rigid in construction, which can cause discomfort for the wearer, especially while sleeping or during activities. The devices, such as the scrunchie, may also be difficult to use in that it may require know-how and or dexterity, or the assistance of another individual to correctly manipulate the hair into the device or vice versa.

SUMMARY OF THE INVENTION

In accordance with one aspect of the disclosure, a method of using styling tape for body part and hair accessorizing is disclosed. The method may include cutting a self-adhesive tape into a strip and stretching it to obtain at least some tension. The user may wrap the self-adhesive strip around a bundle of hair or a body part, and may press the self-adhesive strip onto itself to retain the strip on the bundle of hair or body part.

Figure 1:
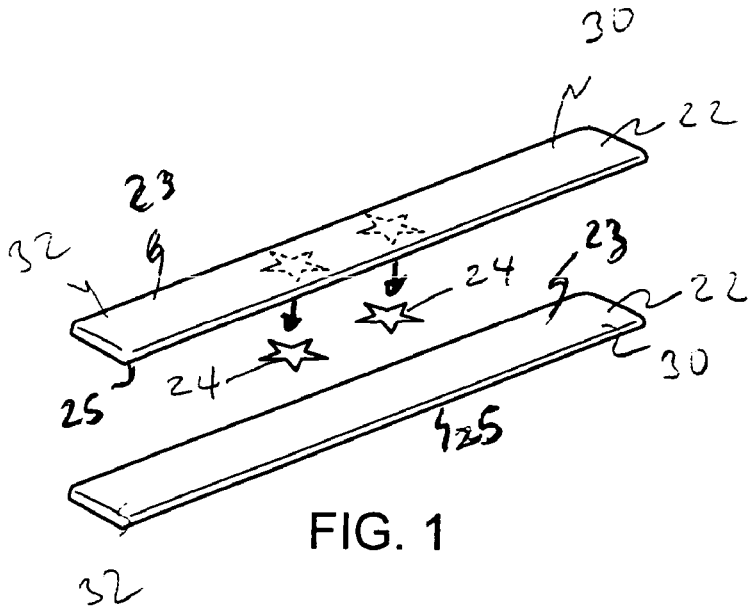
FIG. 1 is a perspective view of two strips of styling tape, wherein one of the strips includes cut-out portions.

While the method and device described herein are susceptible to various modifications and alternative constructions, certain illustrative embodiments thereof are shown in the drawings and will be described below in detail. However, there is no intention to limit the invention to the specific forms disclosed, but on the contrary, the intention is to cover all modifications, alternative constructions, and equivalents falling within the spirit and scope of the invention and the appended claims.

DETAILED DESCRIPTION

Referring to the drawings, and with specific reference to FIG. 1, a styling tape strip is generally depicted by reference numeral 22. As shown therein, the styling tape strip 22 includes a first surface 23, a second surface 25, a first end 30, and a second end 32.

In one exemplary embodiment, the styling tape strip 22 may be constructed with latex, and more specifically with natural rubber latex. The styling tape strip 22 may have many desired qualities including, but not limited to, being self-adhesive, being perforated, colorful, and cutable with scissors, as well as allowing the skin to breathe and/or absorb virtually no moisture. The styling tape strip 22 may have enough inherent adhesiveness to adhere two styling tape strips 22 and/or two portions of the same styling tape strip 22 securely together, but may lack the adhesiveness to securely stick to objects, such as hair and skin by itself. As such, the styling tape strip 22 may be used to securely adhere to itself, while not securely adhering to skin. The styling tape strip 22 may, however, be constructed of any other material that is able to accomplish the intended purpose.

The styling tape strip 22 may be cut with ordinary scissors into a great variety of shapes, such as swirls, hearts, stars, waves, flowers, letters, numbers, and other various indicia, and the resulting cut-out shapes 24 may be adapted to stick to a separate, additional styling tape strip 22. Similarly, the styling tape strip 22 itself may be cut with ordinary scissors into a great variety of elongate shapes. In use, the strip 22 may be wrapped around any number of objects, including but not limited to, bundles of hair, clothing, a neck, a wrist, fingers, etc.

Figure 4:
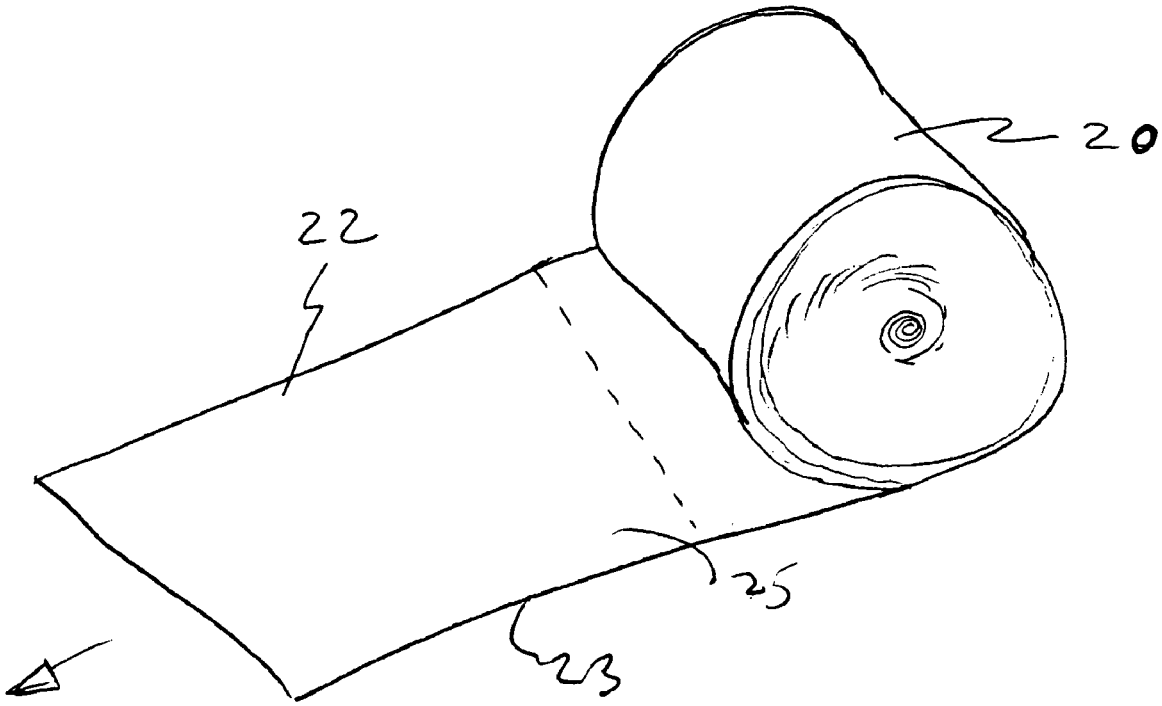
FIG. 4 is a perspective view of a roll of styling tape.

In one exemplary embodiment, as shown in FIG. 4, the user may unroll a portion of tape from a roll of self-adhesive styling tape 20, and cut the strip 22 from the unrolled portion. The strip 22 may be of a variety of widths and lengths, as desired by the user. The strip 22, for example, may be the full width of the tape as unrolled from the roll of self-adhesive tape, or may be cut into any smaller width desired. Similarly, the strip 22 may be cut into any length as needed for the intended accessorizing purpose. For example, the user may desire to use the strip 22 to fit around a bundle of hair, for which a short strip 22 may be used, or the user may desire to make a choker necklace from the strip 22, for which a longer strip 22 would be needed.

Figure 2:
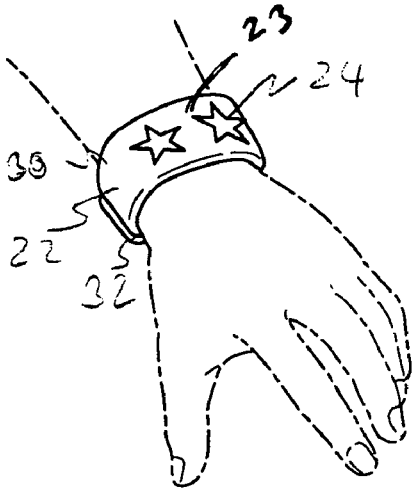
FIG. 2 is a perspective view of the styling tape of FIG. 1 on a wrist.

The user may desire to use one or more cut-outs 24 with the strip 22, as seen in FIGS. 1 and 2, by creating the cut-outs 24 and attaching them to the strip 22. The cut-outs 24 may be attached to the strip 22 in several ways, including, but not limited to, using the self-adhesive properties of the tape, glue, pins, fasteners etc. If using the self-adhesive properties of the cut-outs 24 and/or the strip 22, the user may press the second surface 25 of the cut-outs 24 and the first surface 23 of the strip 22 firmly together, thereby attaching the cut-outs 24 to the strip 22. The cut-outs may be of a different color than the strip 22, and like the strip 22, may have a plurality of colors.

In one exemplary embodiment, the user may stretch or elongate the strip 22 prior to or during placement of the strip 22 around the body part or bundle of hair. For example, either as or before the user places the strip 22 around an object, the user may stretch the strip 22 or otherwise place the strip 22 into tension. The user may stretch the strip 22 as little or as much as desired, depending on the intended use of the strip 22. If the strip 22, for instance, is used to create a chocker necklace around the neck of a child, the strip 22 may be stretched only enough to prevent sagging of the strip 22, whereas if the strip 22 is used to hold the bundle of hair together, the strip 22 may be stretched enough to ensure that the strip 22 properly secures the bundle of hair.

Figure 3:
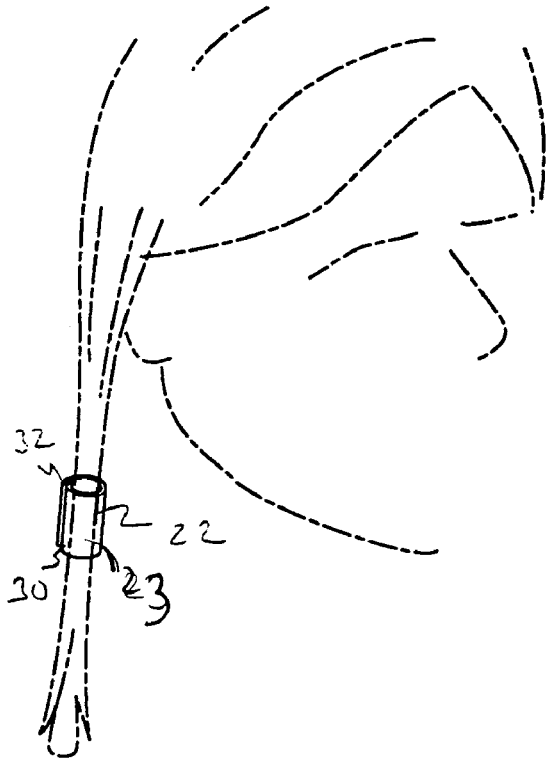
FIG. 3 is a perspective view of the styling tape FIG. 1 around a bundle of hair.

In one exemplary embodiment, to wrap the strip 22 around the object (FIGS. 2 and 3), such as the body part or the bundle of hair, the user may hold the first end of the strip 30 against or near the object and proceed to bring the second end 32 of the strip 22 around the object, toward the first end 30, such that the second surface 25 of the strip 22 abuts the object. To secure the ends 30, 32 to each other, the user may press the second surface 25 of the second end 32, and the first surface 23 of the first end 30 together, thereby securing the ends 30, 32 to each other. Additionally and/or alternatively the strip 22 may be secured to the strands of hair and/o to itself using tape, glue, pins, other various types of fasteners, including but not limited to, hook and loop, snaps, VELCRO®, etc.

While the foregoing detailed description has been described with reference to specific examples, which are intended to be illustrative only and not to be limiting of the disclosure, it will be apparent to those of ordinary skill in the art that changes, additions or deletions may be made to the disclosed embodiments without departing from the spirit and scope of the invention.

What is claimed is:

1. A method of accessorizing hair comprising:

Provide two separate rolls of different colors, wherein each of said rolls having a self adherent material along its entire length, said material being resiliently stretchable, Cutting a strip from a first of said rolls, wherein said strip having a first side and a second side, a first end and a second end, Cutting said material of a second roll into one or more separate shapes, Placing at least one of said shapes onto one of said sides of said strip, Wrapping the strip around strands of hair, Engaging said first and second ends of the strip to secure the strip around the strands of hair, wherein the ends securely adhere to themselves while not being securely adherent to said strands of hair.

2. The method of claim 1, further including stretching the strip into tension.

3. The method of claim 1, further including at least partially unrolling the roll of material.

4. The method of claim 1, wherein the adhesive is disposed on the first and second sides of the material.

5. The method of claim 1, wherein the adhesive is integral to the material.

6. The method of claim 1, wherein the material is perforated.

7. The method of claim 1, wherein the material is constructed from a rubber latex material.

8. The method of claim 1, wherein the strip can be of a variety of widths or lengths.

9. The method of claim 1, wherein the strip can variable stretch or elongate.

* * * * *